US006837230B2

(12) United States Patent
Nobe et al.

(10) Patent No.: US 6,837,230 B2
(45) Date of Patent: Jan. 4, 2005

(54) IGNITION DEVICE FOR AN INTERNAL COMBUSTION ENGINE

(75) Inventors: Hisanori Nobe, Tokyo (JP); Yusuke Naruse, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 4 days.

(21) Appl. No.: 10/293,514

(22) Filed: Nov. 14, 2002

(65) Prior Publication Data

US 2004/0011343 A1 Jan. 22, 2004

(30) Foreign Application Priority Data

Jul. 22, 2002 (JP) ..... 2002-212361

(51) Int. Cl.[7] ..... F02P 3/055
(52) U.S. Cl. ..... 123/644; 123/650
(58) Field of Search ..... 123/630, 644, 123/650, 651, 652, 618

(56) References Cited

U.S. PATENT DOCUMENTS

| | | | | | |
|---|---|---|---|---|---|
| 4,367,722 | A | * | 1/1983 | Mizuno | 123/644 |
| 4,890,009 | A | * | 12/1989 | Miyazaki et al. | 327/108 |
| 4,892,073 | A | * | 1/1990 | Yamamoto et al. | 123/406.14 |
| 5,309,888 | A | * | 5/1994 | Deutsch et al. | 123/609 |
| 5,558,074 | A | * | 9/1996 | Fukatsu et al. | 123/647 |
| 5,664,550 | A | * | 9/1997 | Ito et al. | 123/630 |
| 5,735,254 | A | * | 4/1998 | Palara et al. | 123/644 |
| 5,967,128 | A | * | 10/1999 | Onuki et al. | 123/644 |
| 6,057,728 | A | * | 5/2000 | Igarashi | 327/546 |
| 6,378,514 | B1 | * | 4/2002 | Kaminaga et al. | 123/633 |
| 6,526,953 | B1 | * | 3/2003 | Inagaki | 123/609 |
| 6,539,929 | B2 | * | 4/2003 | Ito et al. | 123/630 |
| 6,595,194 | B1 | * | 7/2003 | Ito et al. | 123/644 |
| 6,684,867 | B2 | * | 2/2004 | Ito et al. | 123/644 |
| 2004/0011342 | A1 | * | 1/2004 | Fukatsu | 123/630 |

FOREIGN PATENT DOCUMENTS

| | | | | |
|---|---|---|---|---|
| EP | 1103720 | * | 5/2001 | F02P/17/12 |
| JP | 7958 | * | 1/1980 | F02P/3/04 |
| JP | 67062 | * | 3/1991 | F02P/3/05 |
| JP | 5-79436 | | 3/1993 | |
| JP | 8-28415 | | 1/1996 | |
| JP | 2001-193617 | | 7/2001 | |
| JP | 2001-248529 | | 9/2001 | |
| JP | 52683 | * | 2/2004 | F02P/3/055 |

* cited by examiner

*Primary Examiner*—Hai Huynh
(74) *Attorney, Agent, or Firm*—Sughrue Mion, PLLC

(57) ABSTRACT

An ignition device for an internal combustion engine includes a control circuit that generates an ignition signal for allowing or interrupting the supply of a primary current of an ignition coil under control, a waveform shaping circuit that waveform-shapes the ignition signal, a switching element that allows and interrupts the supply of the primary current on the basis of the ignition signal that is waveform-shaped to generate a high voltage on a secondary side of the ignition coil, and an over-current protection circuit that forcedly interrupts the supply of the primary current and holds an interrupt state until the ignition signal turns off when the primary current of the ignition coil exceeds a given value.

13 Claims, 13 Drawing Sheets

IGNITION DEVICE FOR AN INTERNAL COMBUSTION ENGINE

BACKGROUND OF THE INVENTION

1. Field of the Invention

The present invention relates to an ignition device for an internal combustion engine which realizes downsizing and high reliability by reducing a power consumption with the use of an over-current protection circuit or an energization time abnormality protection circuit.

2. Description of the Related Art

There are ignition devices having a switching element and a variety of functions for protecting the switching element. For example, there are a breaker circuit for protection against a continuous energization state which is caused in the case where an ignition signal becomes a given value or more or in the case where a GND potential of a control device that generates the ignition signal becomes higher than the GND potential of an ignition power supply, a current limit circuit for protection against an over-current of a switching element which occurs due to the abnormality of a power supply voltage, and so on.

A conventional ignition device for an internal combustion engine will be described with reference to the accompanying drawings. FIG. 12 is a diagram showing the structure of the conventional ignition device for an internal combustion engine.

Referring to FIG. 12, reference numeral 1 denotes a control circuit, reference numeral 2 denotes a battery, reference numeral 3 denotes an ignition coil, reference numeral 4 denotes an ignition plug, and reference numeral 30 denotes a switching circuit.

Also, in the figure, the ignition device is made up of the ignition coil 3 and the switching circuit 30 including a switching element 5 that allows and interrupts the supply of a primary current to the ignition coil 3 on the basis of an ignition signal a from the control circuit 1.

The switching circuit 30 is made up of a wave form shaping circuit 8 that waveform-shapes the ignition signal a, the switching element 5, a protection circuit 6 for protecting the switching element 5 in the case where abnormality occurs in the ignition signal a, and a protection circuit 20 that turns off the switching element 5 at the time of abnormality of a power supply voltage.

The protection circuit 6 is an over-current protection circuit for protecting the switch element 5 against the over-current that occurs in the case where the ignition signal a becomes a given value or more, or in the case where the power supply voltage is abnormal. The over-current protection circuit 6 controls the input of the switching element 5 on the basis of a detection resistor 61 which is inserted in series to the primary coil of the ignition coil 3 and the switching element 5 and a result of comparing the terminal voltage with a given voltage of the reference power supply 62 so as to prevent a current of a given value or more from flowing.

Also, the protection circuit 20 is an over-voltage breaking circuit that breaks the primary current by turning off the input of the switching element 5 in the case where the power supply voltage abnormally comes up due to load dump or the like. The circuit is one to protect the power switch because the over-current protection circuit 6 operates due to a rise of the power supply voltage, and the power consumption of the switching element 5 becomes large, resulting in a fear that the power switch is broken.

In the case where a power is not supplied to the switching circuit 30 from the battery 2 (in the case where no power supply terminal is provided), it is general that the same function is provided to the control circuit 1 with respect to a serge such as the load dump, and the ignition signal is interrupted for protection. In the case where this function is not provided in the control circuit 1, it is necessary that a chip size or a radiator plate is enlarged for protection.

Then, the operation of the conventional ignition device for an internal combustion engine will be described with reference to the accompanying drawings. FIG. 13 is a timing chart showing the operation of the conventional ignition device for an internal combustion engine.

The switching element 5 is driven in response to a waveform-shaped signal e on the basis of the ignition signal a so as to allow or interrupt the supply of a primary current f to the ignition coil 3.

When the ignition signal a is normal, the current f that flows on the primary side of the ignition coil 3 has a target value as shown in FIG. 13. The supply of the primary current f to the ignition coil 3 is allowed or interrupted by the switching element 5 to generate a high voltage on the secondary side of the ignition coil 3 and ignite by the ignition plug 4.

On the other hand, in the case where the ignition signal a becomes long for some abnormality, when the current f of the primary coil which depends on the power supply voltage reaches a current value which is set by the over-current protection circuit 6, control is made so that the current f does not have the value or more on the basis of the output of the over-current protection circuit 6.

To make the power supply voltage of an automobile high is an important object for realizing the assumption of an electric load which is predicted in the future to be necessary to establish the environmental technology and the IT technology from the viewpoints of the international and global scales.

When an increase in the electric load is taking into consideration, it is more preferable that the power supply is higher, but from the viewpoint of safety, a 42 V power supply (battery voltage 36 V) is proposed.

The higher power supply has many advantages in view of the performance but has many difficulties in view of ensuring the safety and protection of the parts.

Similarly, in the ignition switching circuit, when a conventional product is used as it is, there arises a problem in that sufficient safety cannot be ensured.

For example, as to the protecting function against the over-current due to the abnormality of the ignition signal, even if the current can be limited, a voltage that is applied to the switching element becomes high, and the power consumption at the time of current limit becomes very large. As a result, even if a function which is originally added to protect the power switch is effected, there is the possibility that the switching element is broken.

In the conventional protection circuit thus structured, sufficient protection cannot be conducted to the higher power supply. For that reason, it is necessary to review modifications such as the application of a large allowable power of the switching element and the enlargement of the radiator plate or another protection circuit.

SUMMARY OF THE INVENTION

The present invention has been made in order to solve the above-mentioned problems with the conventional device, and therefore an object of the present invention is to obtain an ignition device for an internal combustion engine which is capable of reducing a power consumption and downsizing an element or a radiator plate.

According to the present invention, there is provided an ignition device for an internal combustion engine, including: a waveform shaping circuit that waveform-shapes an ignition signal for controlling the supply/interruption of a primary current of an ignition coil; a switching element that allows and interrupts the supply of the primary current on the basis of the ignition signal that is waveform-shaped to generate a high voltage on a secondary side of the ignition coil; and an over-current protection circuit that forcedly interrupts the supply of the primary current and holds an interrupt state until the ignition signal turns off when the primary current of the ignition coil exceeds a given value.

As a result, there is obtained an effect that the power consumption of the switching element is reduced, thereby realizing downsizing of the element and the radiator plate.

Further, according to the present invention, there is provided an ignition device for an internal combustion engine, including: a waveform shaping circuit that waveform-shapes an ignition signal for controlling the supply/interruption of a primary current of an ignition coil; a switching element that allows and interrupts the supply of the primary current on the basis of the ignition signal that is waveform-shaped to generate a high voltage on a secondary side of the ignition coil; an over-current protection circuit that forcedly interrupts the supply of the primary current and holds an interrupt state until the ignition signal turns off when the primary current of the ignition coil exceeds a given value; and an energization time abnormality protection circuit that forcedly interrupts the supply of the primary current of the ignition coil and holds an interrupt state until the ignition signal turns off when the ignition signal exceeds a given energization time.

As a result, there is obtained an effect that the reliability of the protecting function is enhanced.

Further, according to the present invention, there is provided an ignition device for an internal combustion engine, including: a waveform shaping circuit that waveform-shapes an ignition signal for controlling the supply/interruption of a primary current of an ignition coil; a switching element that allows and interrupts the supply of the primary current on the basis of the ignition signal that is waveform-shaped to generate a high voltage on a secondary side of the ignition coil; an over-current protection circuit that outputs a given signal when the primary current of the ignition coil exceeds a given value; and an energization time abnormality protection circuit that forcedly interrupts the supply of the primary current of the ignition coil and holds an interrupt state until the ignition signal turns off when the primary current of the ignition coil exceeds a given value or the ignition signal exceeds a given energization time on the basis of the given signal.

As a result, there is obtained an effect that the number of parts can be reduced, thereby lowering the manufacturing cost.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of preferred embodiments of the present invention with reference to the accompanying drawings.

Figure 1:
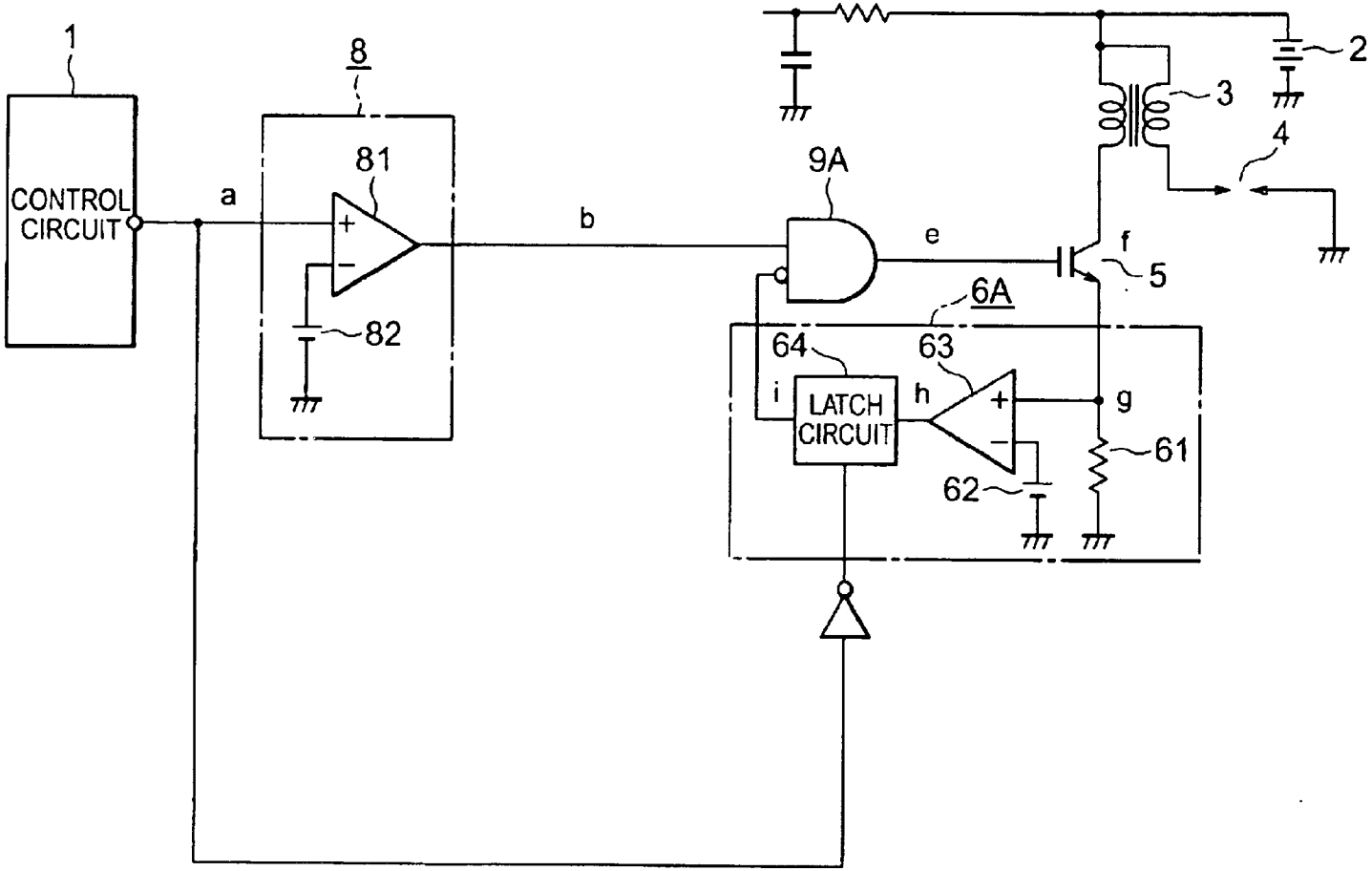
FIG. 1 is a diagram showing the structure of an ignition device for an internal combustion engine in accordance with a first embodiment of the present invention.

An ignition device for an internal combustion engine in accordance with a first embodiment of the present invention will be described with reference to the accompanying drawings. FIG. 1 is a diagram showing the structure of the ignition device for an internal combustion engine in accordance with the first embodiment of the present invention. In the respective drawings, the same references denote identical or like parts.

Referring to FIG. 1, reference numeral 1 denotes a control circuit, reference numeral 2 denotes a battery, reference numeral 3 denotes an ignition coil, reference numeral 4 denotes an ignition plug, and reference numeral 5 denotes a switching element such as an IGBT (insulated gate bipolar transistor).

Also, in the figure, reference 6A denotes an over-current protection circuit that forcedly interrupts the primary current when a primary current of the ignition coil 3 exceeds a given value, and holds an interrupt state until the output of the ignition signal becomes low (off), reference numeral 8 denotes a waveform shaping circuit that waveform-shapes the ignition signal, and reference 9A denotes a logic circuit (AND gate) that takes the logic of an output of the waveform shaping circuit 8 and an output of the over-current protection circuit 6A.

The switching element 5 allows and interrupts the supply of a primary current f to the ignition coil 3 in response to an ignition signal a from the control circuit 1. As a result, a high voltage is generated on a secondary side of the ignition coil 3 to ignite by the ignition plug 4.

The over-current protection circuit 6A is made up of a detection resistor 61 which is inserted in series to a primary coil of the ignition coil 3 and the switching element 5, a comparator 63 that compares a terminal voltage of the detection resistor 61 with a given voltage of a reference power supply 62 (for example, a value corresponding to 1.6 times of the maximum value of the primary current in a normal state), and a latch circuit 64 that controls the input of the switching element 5 through the logic circuit 9A on the basis of an output h of the comparator 63 and the ignition signal a that passes through an inverter from the control circuit 1. Also, the waveform shaping circuit 8 is made up of a comparator 81 and a reference power supply 82.

In FIG. 1, the input of the switching element 5 is interrupted through the logic circuit 9A, but the same effect is obtained even if the input of the switching element 5 is directly interrupted.

Then, the operation of the ignition device for an internal combustion engine in accordance with the first embodiment will be described with reference to the accompanying drawings.

Figure 2:
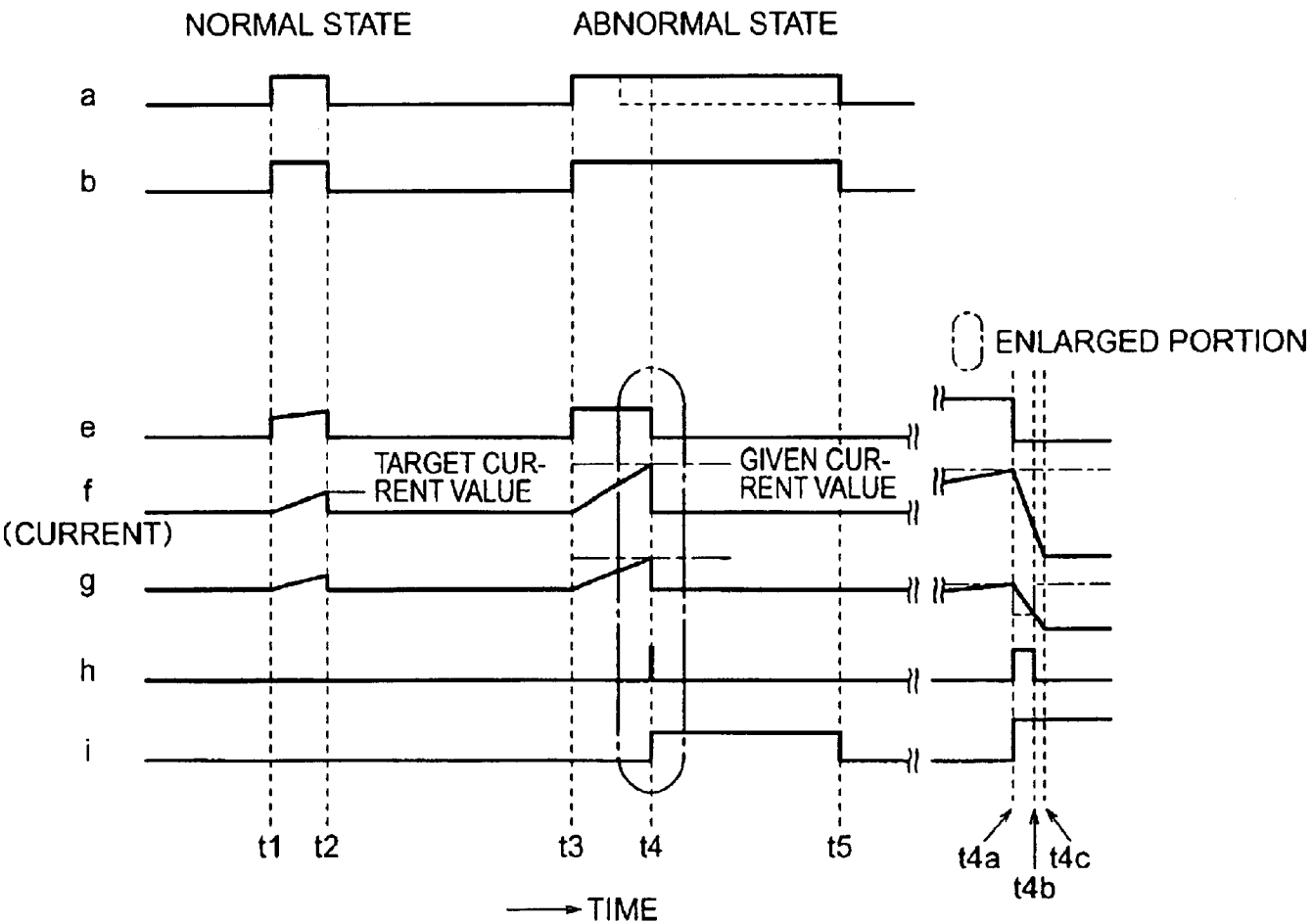
FIG. 2 is a timing chart showing the operation of the ignition device for an internal combustion engine in accordance with the first embodiment of the present invention.

FIG. 2 is a timing chart showing the operation of the ignition device for an internal combustion engine in accordance with the first embodiment of the present invention.

Figure 3A:
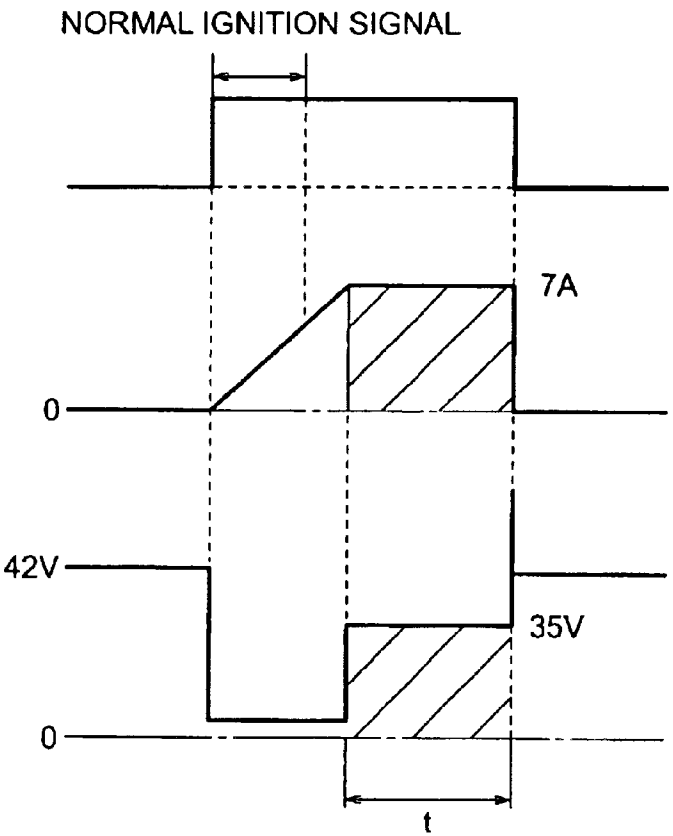
FIGS. 3A and 3B are waveform diagrams showing the operation waveforms of a conventional over-current protection circuit and an over-current protection circuit in accordance with the first embodiment of the present invention in comparison, respectively.
Figure 3B:
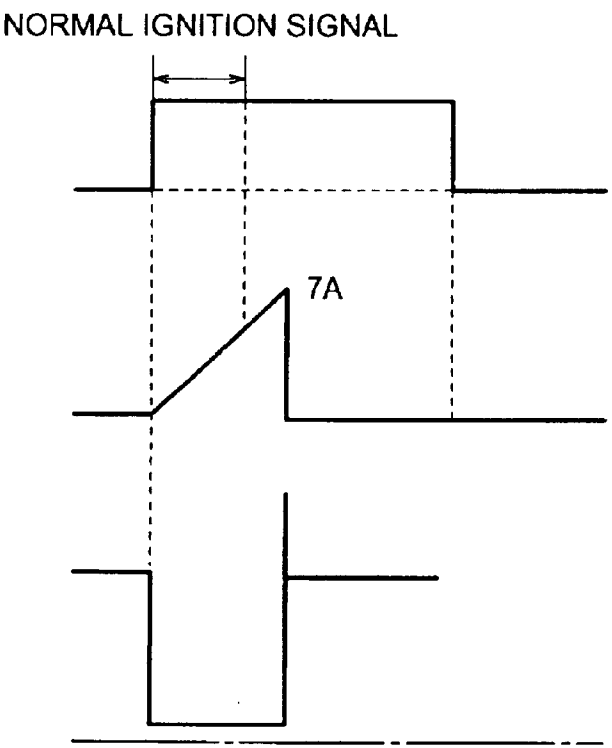
Figure 4A:
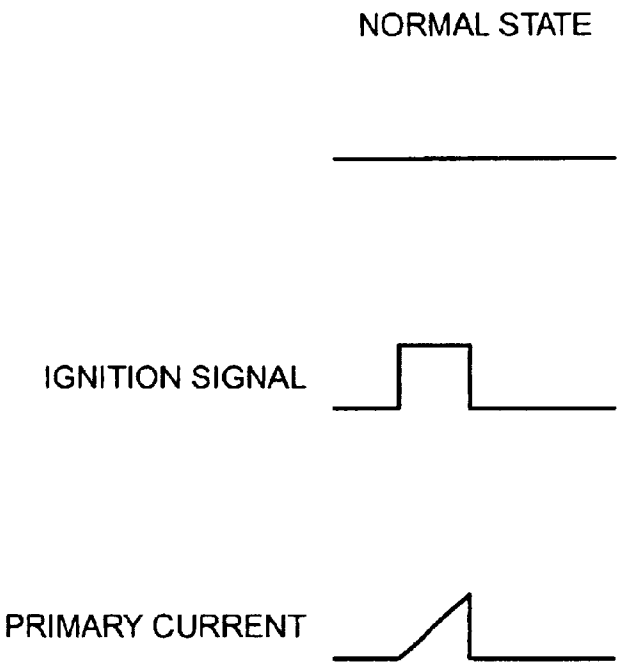
FIGS. 4A and 4B are waveform diagrams showing the operation waveforms in a normal state and in a power supply voltage abnormal state due to serge in comparison, respectively.
Figure 4B:
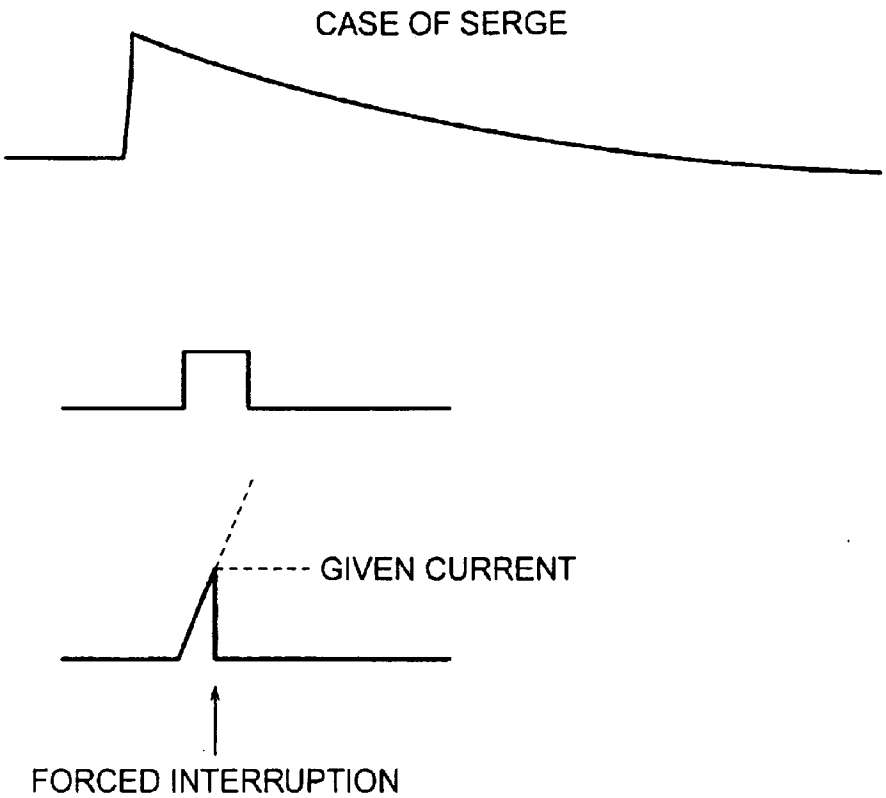

Also, FIGS. 3A and 3B are waveform diagrams showing the operation waveforms of a conventional over-current protection circuit and the over-current protection circuit in accordance with the first embodiment of the present invention in comparison, respectively. FIGS. 4A and 4B are waveform diagrams showing the operation waveforms in a normal state and in a power supply voltage abnormal state due to serge in comparison, respectively.

FIG. 2 shows the operation waveforms of the respective portions in a normal time (t1 to t2) and an abnormal time (t3 to t5) where an energization time is longer than a given value. In the case where the energization time is longer than the given value, the primary current f of the ignition coil 3 is forcedly interrupted and held by the over-current protection circuit 6A. The operation of detecting, interrupting and holding the over-current is indicated by e, f, g, h and i in FIG. 2. Also, the enlarged detected portion of the over-current (t4a to t4c) is shown on a right side.

When a waveform g resulting from converting the primary current f into a voltage reaches a given voltage of the reference power supply 62 of the comparator 63, an output signal h of the comparator 63 becomes high, and an output i of the latch circuit 64 is fixed to high. The output i of the latch circuit 64 remains high until the ignition signal a becomes low (off). When the output of the latch circuit 64 becomes high, the output of the logic circuit 9A becomes low on the basis of the inversion-inputted output i, and the switching element 5 turns off.

Then, the operation of the conventional over-current protection circuit and the over-current protection circuit in accordance with the first embodiment of the present invention will be described in comparison.

FIG. 3A shows the operation waveform of the conventional over-current protection circuit and FIG. 3B shows the operation waveform of the over-current protection circuit in accordance with the first embodiment.

In the first embodiment, for example, in the case where the power supply voltage is 42 V, a coil resistance is 1 Ω, and a current limit value is 7 A, the power consumption of the switching element 5 is reduced by a portion indicated by an oblique line (the following calculation expression) of FIG. 3A as compared with the conventional circuit.

$$V \times I \times t = (42 - 1 \times 7) \times t = 245t(W)$$

In this way, because the power consumption can be reduced, it is possible to downsize the element and the radiator plate.

Also, the operation waveform in the case where an over-voltage is applied as in a battery dump is shown in FIG. 4B. FIG. 4A shows the operation waveform in a normal state.

As shown in FIG. 4B, because the rising of the primary current of the ignition coil 3 is quick when the power supply voltage comes up, the over-current interrupting function of the over-current protection circuit 6A is applied, thereby being capable of protecting the power supply against the over-voltage.

Second Embodiment

Figure 5:
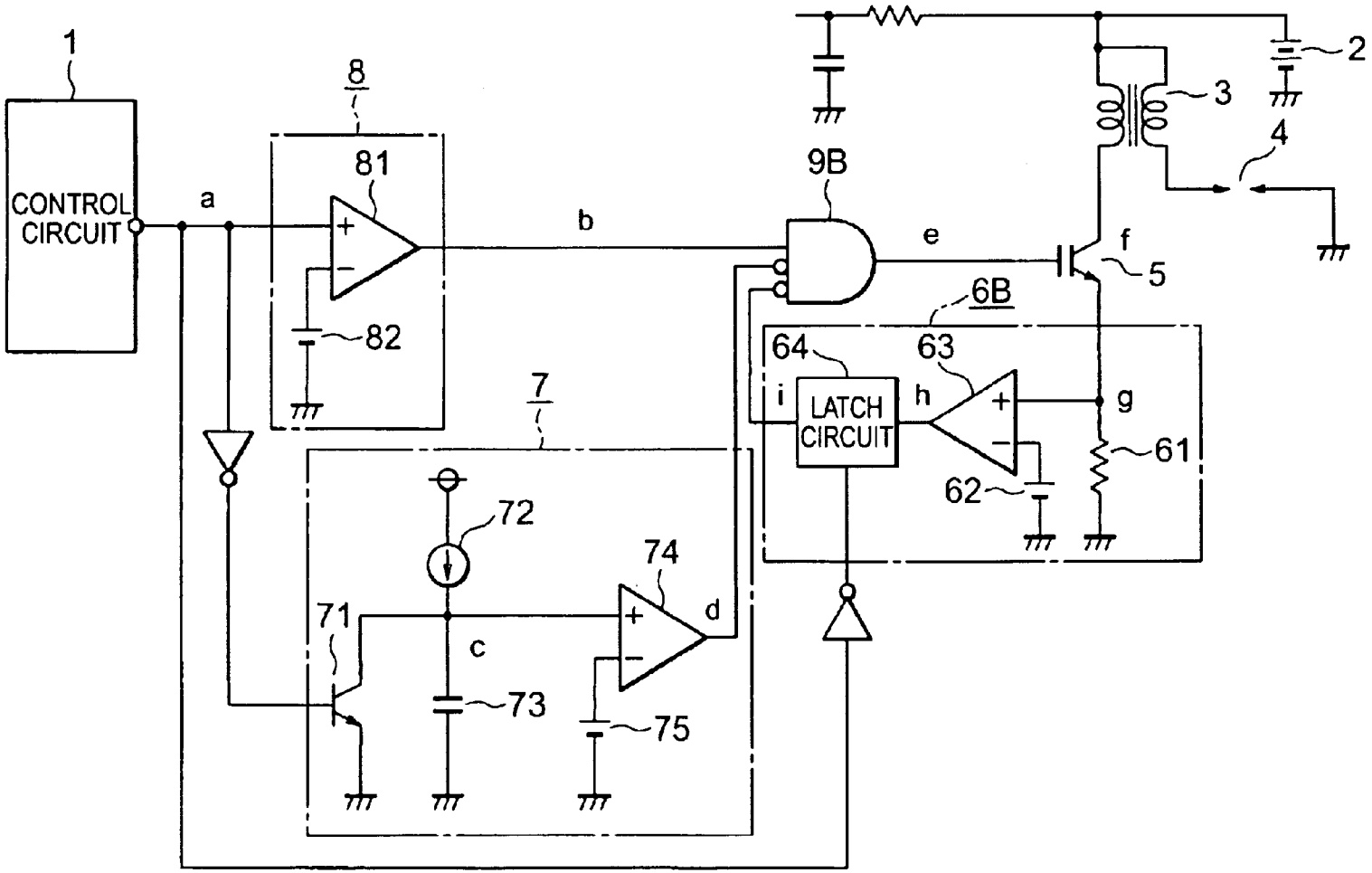
FIG. 5 is a diagram showing the structure of an ignition device for an internal combustion engine in accordance with a second embodiment of the present invention.

An ignition device for an internal combustion engine in accordance with a second embodiment of the present invention will be described with reference to the accompanying drawings. FIG. 5 is a diagram showing the structure of the ignition device for an internal combustion engine in accordance with the second embodiment of the present invention.

Referring to FIG. 5, reference numeral 1 denotes a control circuit, reference numeral 2 denotes a battery, reference numeral 3 denotes an ignition coil, reference numeral 4 denotes an ignition plug, and reference numeral 5 denotes a switching element such as an IGBT (insulated gate bipolar transistor).

Also, in the figure, reference 6B denotes an over-current protection circuit that forcedly interrupts the supply of a primary current and holds an interrupt state until the output of the ignition signal becomes low (off) when the primary current of the ignition coil 3 exceeds a given value, reference numeral 7 denotes an energization time abnormality protection circuit that forcedly interrupts the supply of the primary current of the ignition coil 3 and holds an interrupt state until the ignition signal becomes low (off) when the ignition signal exceeds a given energization time, reference numeral 8 denotes a waveform shaping circuit that waveform-shapes the ignition signal, and reference 9B denotes a logic circuit (AND gate) that takes the logic of an output of the over-current protection circuit 6B, an output of the energization time abnormality protection circuit 7, and an output of the waveform shaping circuit 8.

The energization time abnormality protection circuit 7 is made up of a transistor 71, a constant current source 72, an integration capacitor (integrating circuit) 73, a comparator 74 and a reference power supply 75, in which a constant current of the constant current source 72 is integrated by the integration capacitor 73 on the basis of the ignition signal that passes through an inverter, the integrated voltage and a given voltage of the reference power supply 75 are compared with each other by the comparator 74, and in the case where the integrated voltage is a given voltage or higher, a judgment of an energization time abnormality or GND floating of the control circuit 1 is made, the primary current is forcedly interrupted, and the interruption is maintained until the ignition signal becomes low (off). Also, the waveform shaping circuit 8 is made up of the comparator 81 and the reference power supply 82.

In the above-mentioned first embodiment, the operation in the normal operating condition is described. However, in the case where the power supply voltage is extremely low as in an engine start state, even in the case where the energization time is longer than the given value, there is the possibility that a given primary current is not reached and the over-current interruption does not function. In this case, even if the peak of the primary current is low, there is a fear that the time is long and the power consumption is large. In order to protect this state, in the case where the ignition signal continues for a given time or longer, the primary current is forcedly interrupted and held by the energization time abnormality protection circuit 7.

Then, the operation of the ignition device for an internal combustion engine in accordance with the second embodiment of the present invention will be described with reference to the accompanying drawings.

Figure 6:
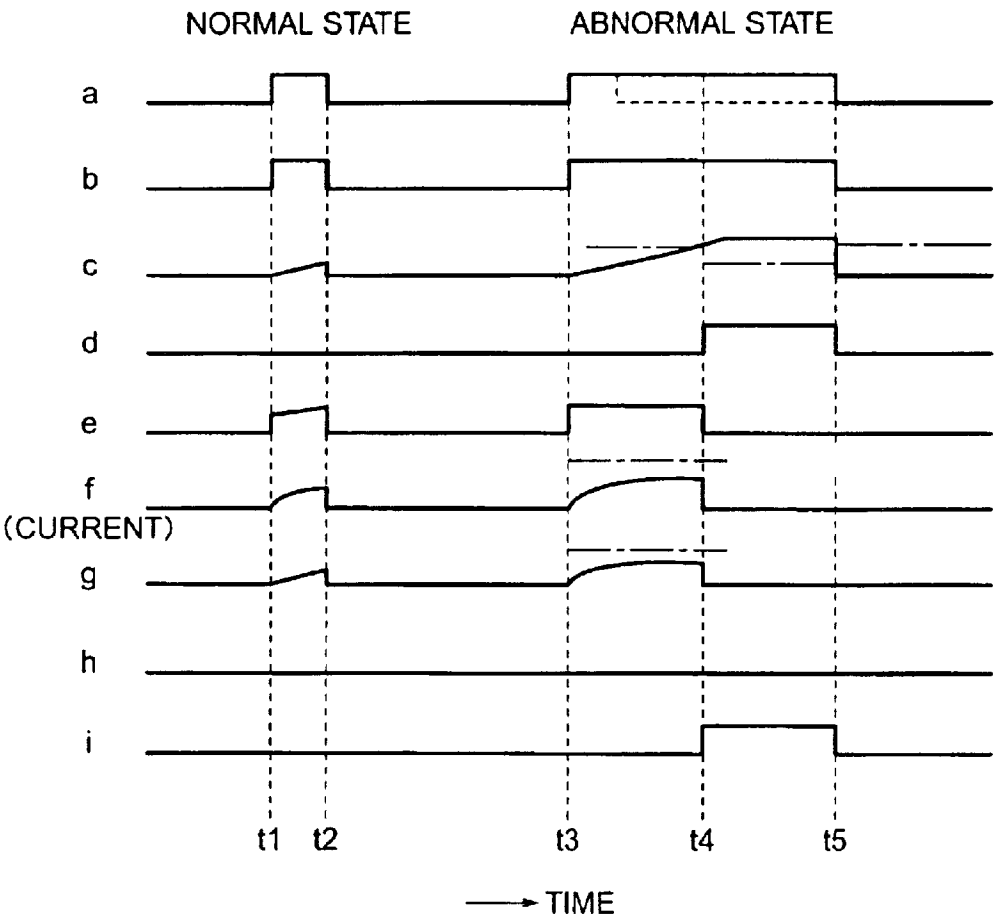
FIG. 6 is a timing chart showing the operation of the ignition device for an internal combustion engine in accordance with the second embodiment of the present invention.
Figure 7:
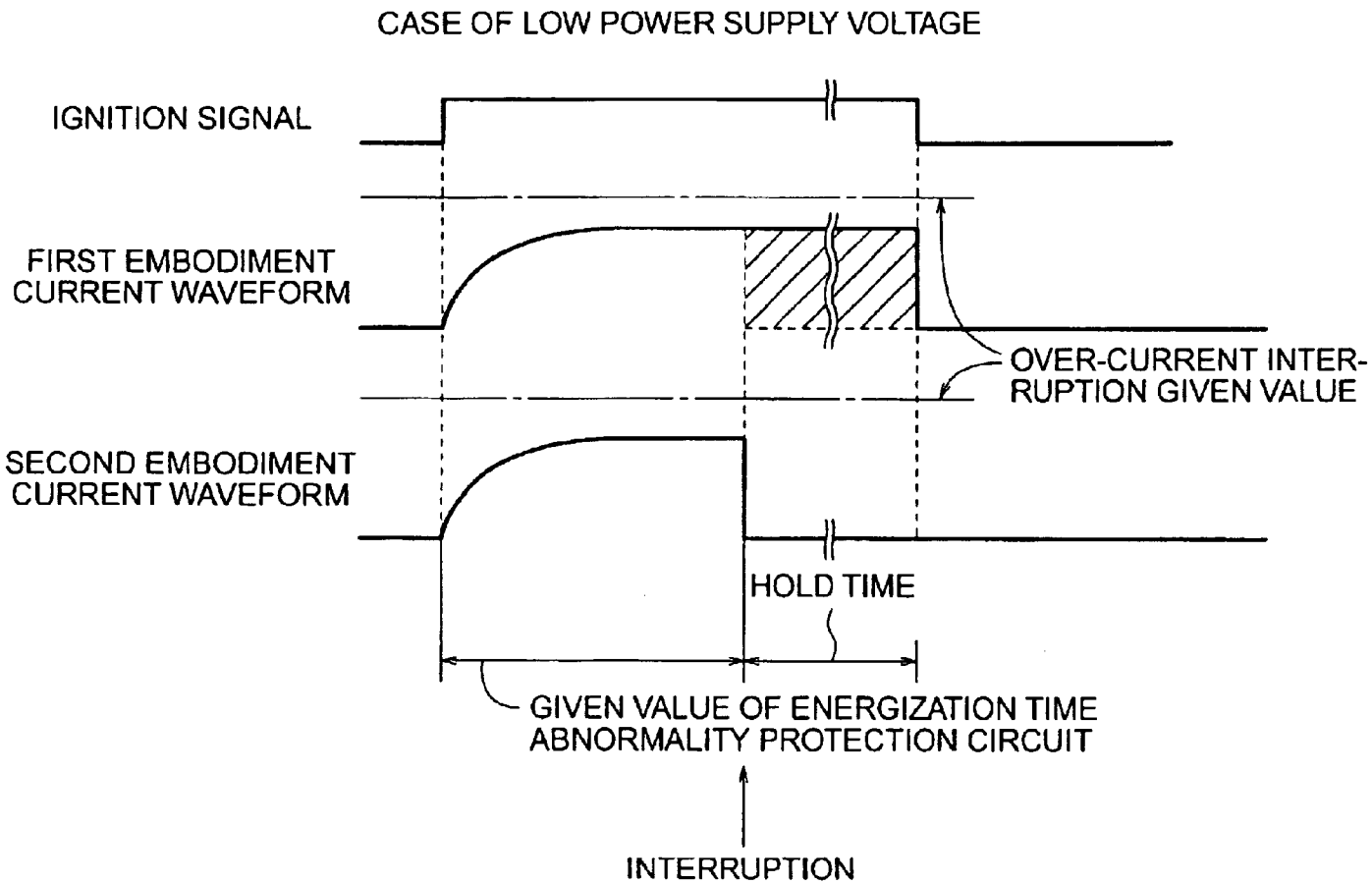
FIG. 7 is a waveform diagram showing the operation waveforms of the first and second embodiments in the case where a power supply voltage is low and an ignition signal is longer than a given time in comparison.

FIG. 6 is a timing chart showing the operation of the ignition device for an internal combustion engine in accordance with the second embodiment of the present invention. Also, FIG. 7 is a waveform diagram showing the operation waveforms of the first and second embodiments when the power supply voltage is low and the ignition signal is longer than a given time in comparison.

The operation of the energization time abnormality protection circuit 7 in the case where the power supply voltage is low will be described with reference to the timing chart of FIG. 6. In the case where the power supply voltage is high, the same operation as that in the above-mentioned first embodiment is conducted.

The integration capacitor 73 is charged from the constant current source 72 on the basis of the ignition signal a (c), and the integrated voltage c and the given voltage of the reference power supply 75 are compared with each other by the comparator 74. An output d of the comparator 74 is transmitted to the switching element 5 through the logic circuit 9B.

In the case where the ignition signal a is normal (t1 to t2), an output e of the logic circuit 9B is determined by an output b of the waveform shaping circuit 8.

On the other hand, in the case where the ignition signal a is long (t3 to t5), the integrated voltage c of the energization time abnormality protection circuit 7 reaches a given value at a time t4, the output d of the energization time abnormality protection circuit 7 is inverted, the output e of the logic circuit 9B becomes low, the switching element 5 turns off, and the primary current f of the ignition coil 3 is interrupted.

In FIG. 7, the comparison is made on the operation in the case where the power supply voltage is low and the ignition signal a is longer than the given time between the first embodiment and the second embodiment.

As described above, the combination of the over-current interrupting function with the energization time abnormality protecting function can realize the protection of the switching element 5 with high reliability with respect to the higher voltage of the power supply.

Third Embodiment

Figure 8:
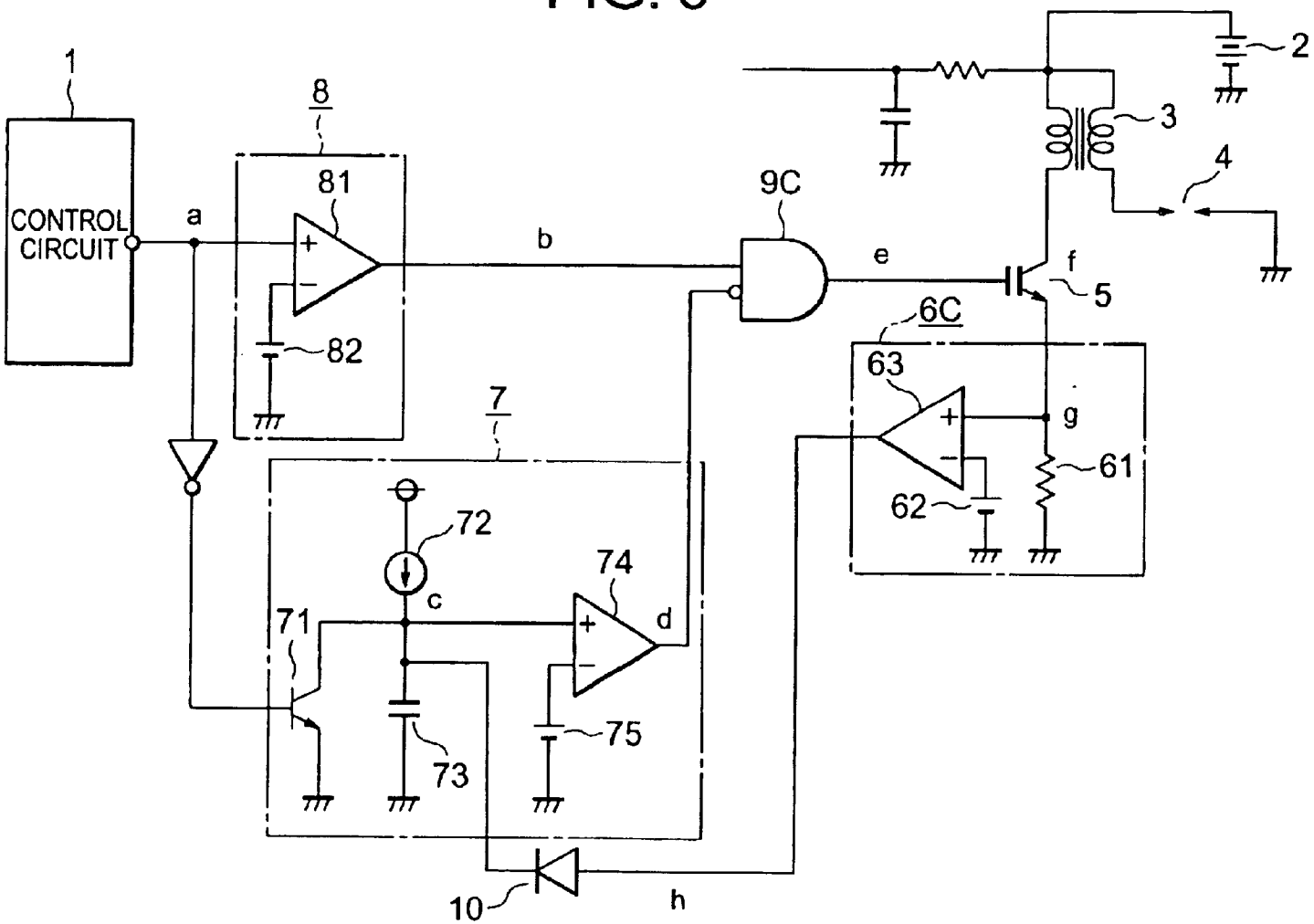
FIG. 8 is a diagram showing the structure of an ignition device for an internal combustion engine in accordance with a third embodiment of the present invention.

An ignition device for an internal combustion engine in accordance with a third embodiment of the present invention will be described with reference to the accompanying drawings. FIG. 8 is a diagram showing the structure of the ignition device for an internal combustion engine in accordance with the third embodiment of the present invention. In the third embodiment, the function shown in the above-mentioned second embodiment is structured by a simpler circuit, thereby reducing the number of parts.

Referring to FIG. 8, reference numeral 1 denotes a control circuit, reference numeral 2 denotes a battery, reference numeral 3 denotes an ignition coil, reference numeral 4 denotes an ignition plug, and reference numeral 5 denotes a switching element such as an IGBT (insulated gate bipolar transistor).

Also, in the figure, reference 6C denotes an over-current protection circuit which is made up of the detection resistor 61 connected in series to the switching element 5, and the comparator 63 that compares a voltage that is generated in the detection resistor 61 with a given voltage of the reference power supply 62 (for example, a value corresponding to 1.6 times of the maximum value of the primary current in a normal state), and which charges an integrating circuit (capacitor) which will be described later in accordance with the output h of the comparator 63, and forcedly interrupts the primary current through the energization time abnormality protection circuit which will be describe later when the primary current exceeds the given value.

Also, in the figure, reference numeral 7 denotes an energization time abnormality protection circuit which is made up of the transistor 71, the integrating circuit (integration capacitor) 73 which integrates the constant current of the constant current source 72 in accordance with the ignition signal that passes through the inverter, and the comparator 74 that compares the integrated voltage with the given voltage of the reference power supply 75, and which forcedly interrupts the primary current of the ignition coil 3 in accordance with the output of the comparator 74 and holds the interruption until the ignition signal becomes low (off), that is, forcedly interrupts the primary current when the ignition signal exceeds the given energization time. In addition, reference numeral 10 denotes a diode. Also, the waveform shaping circuit 8 is made up of the comparator 81 and the reference power supply 82.

Then, the operation of the ignition device for an internal combustion engine in accordance with the third embodiment will be described with reference to the accompanying drawings.

Figure 9:
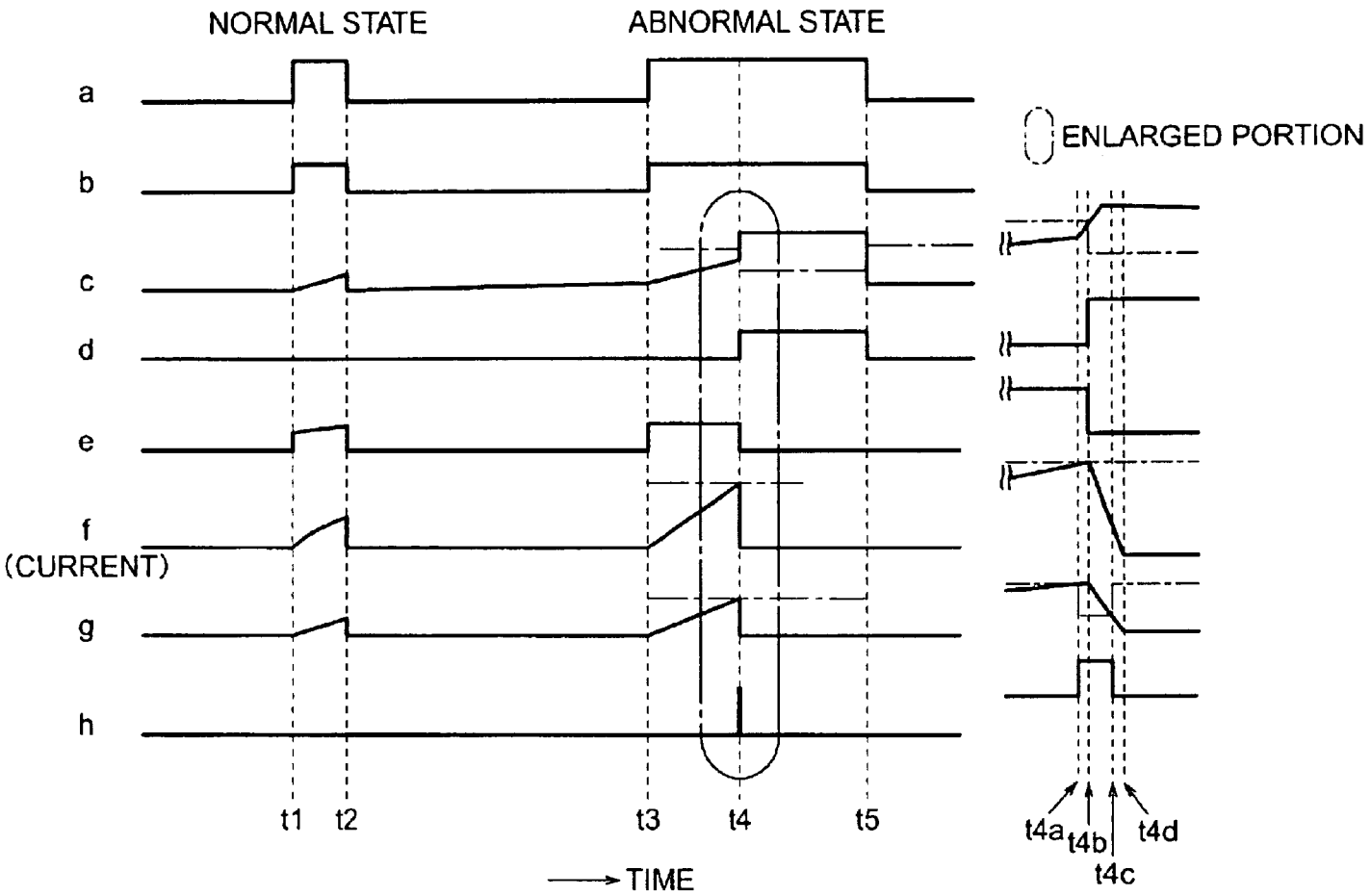
FIG. 9 is a timing chart showing the operation of the ignition device for an internal combustion engine in accordance with the third embodiment of the present invention.
Figure 10A:
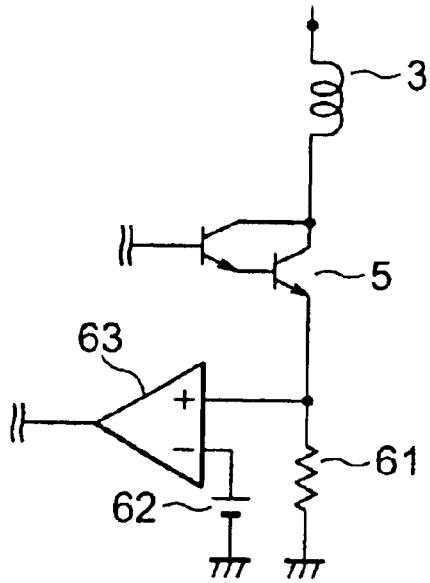
FIGS. 10A and 10B are diagrams showing other circuit structures of a detection means of a primary current of an ignition coil.
Figure 10B:
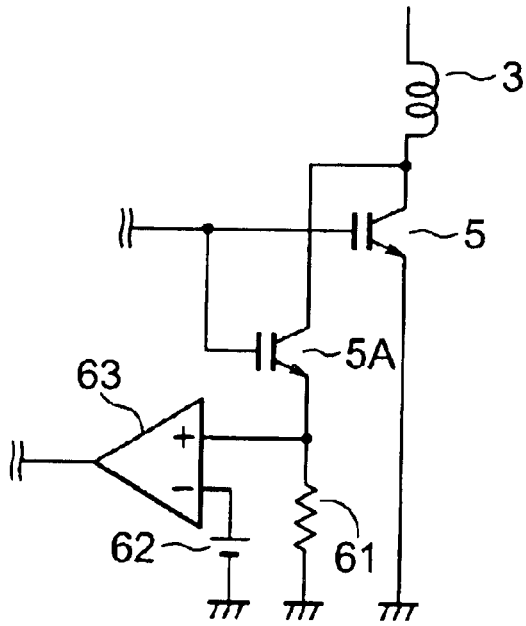
Figure 11A:
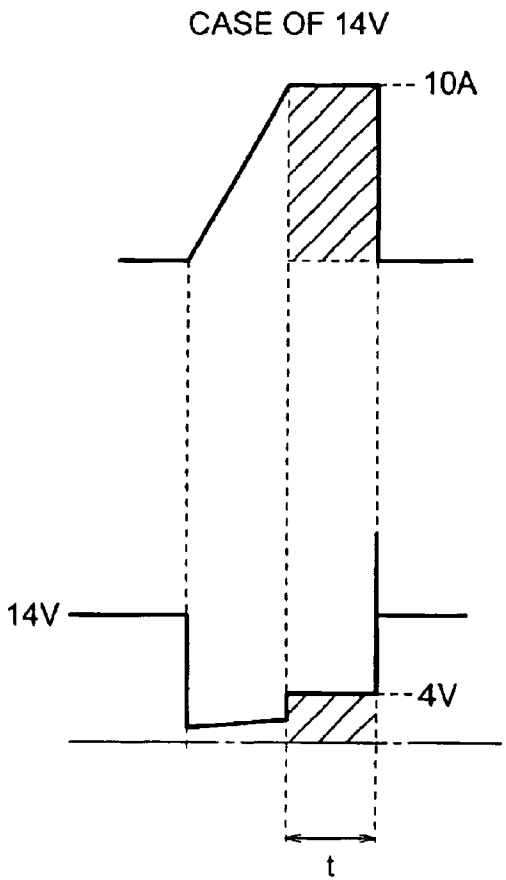
FIGS. 11A and 11B are waveform diagrams showing the operation waveforms in the case where the protection circuit operates at 14V and 42V in comparison.
Figure 11B:
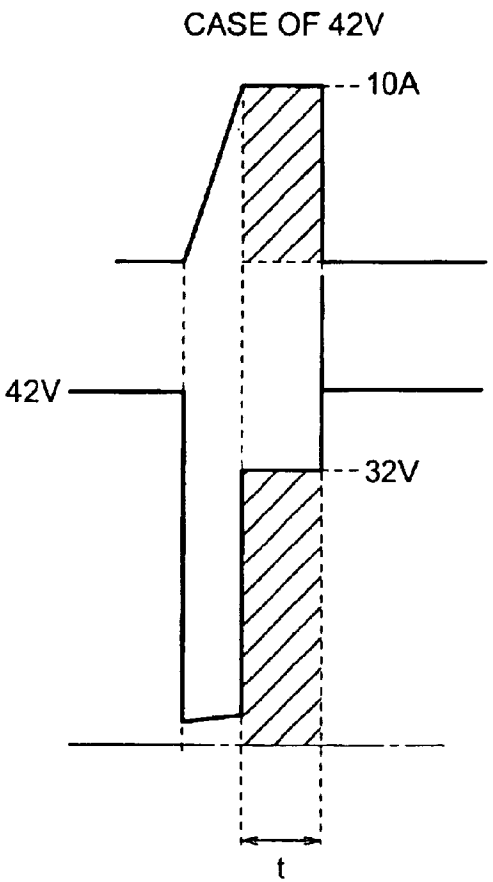
Figure 12:
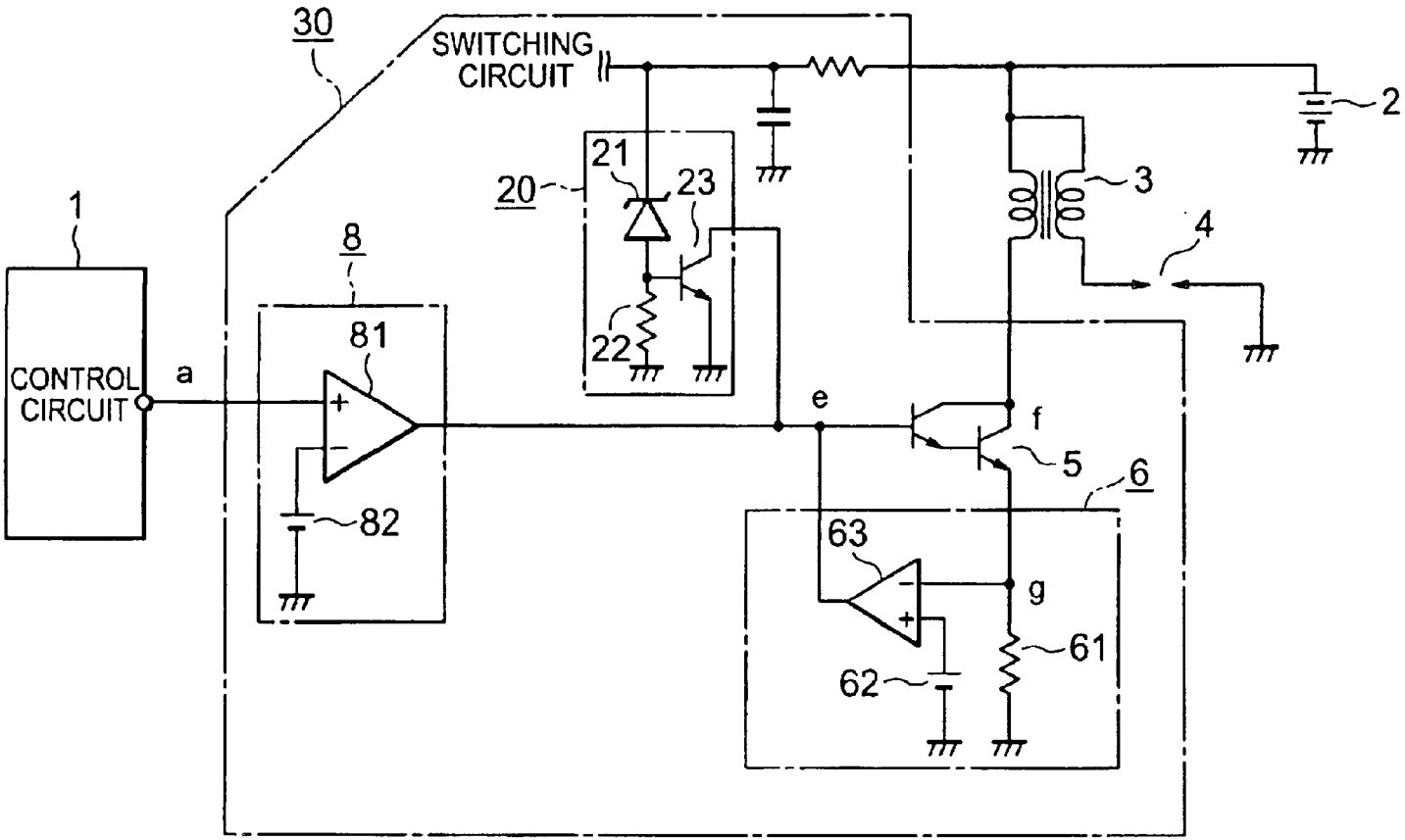
FIG. 12 PRIOR ART
FIG. 12 is a diagram showing the structure of a conventional ignition device for an internal combustion engine.
Figure 13:
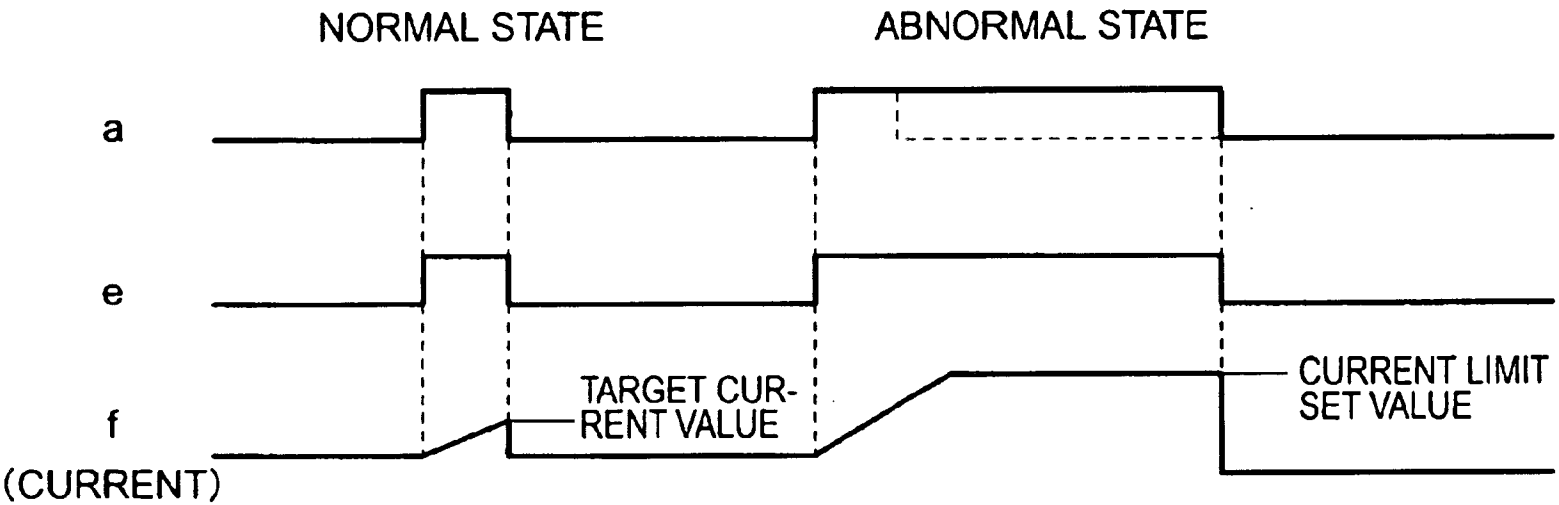
FIG. 13 PRIOR ART
FIG. 13 is a timing chart showing the operation of the conventional ignition device for an internal combustion engine.

FIG. 9 is a timing chart showing the operation of the ignition device for an internal combustion engine in accordance with the third embodiment of the present invention. Also, FIGS. 10A and 10B are diagrams showing other circuit structures of a detection means of the primary current of the ignition coil. Further, FIGS. 11A and 11B are waveform diagrams showing the operation waveforms in the case where the protection circuit operates at 14V and 42V in comparison.

FIG. 9 shows the operation waveforms of the respective portions in a normal time (t1 to t2) and an abnormal time (t3 to t5) where an energization time is longer than a given value. Also, the enlarged portion where the over-current is detected and the primary current is forcedly interrupted is shown on a right side.

In the third embodiment, the over-current protection circuit 6C rapidly charges the integrating circuit 73 in the energization time abnormality protection circuit 7 upon the detection of the over-current (t4) (h). That is, the comparator 63 of the over-current protection circuit 6C has an amplifying function, and supplies a current corresponding to a difference between a voltage generated in the detection resistor 61 and the voltage of the reference power supply 62 to the integrating circuit 73. Also, the comparator 74 in the energization time abnormality protection circuit 7 compares the given voltage of the reference power supply 75 with the charging voltage (integrated voltage) c, and forcedly interrupts the primary current f through the logic circuit 9C and holds the interruption in the case where the charging voltage c becomes a given voltage or higher.

In FIG. 9, the output of the comparator 74, the drive signal of the switching element 5 downstream of the logic circuit 9C and the primary current wave form are indicated by d, e and f, respectively.

As a result, the latch circuit 64 for holding the interruption after the forced interruption of the primary current by the detection of the over-current can be deleted, and the logic circuit 9B can be simplified as in the logic circuit 9C, as compared with the above-mentioned second embodiment. Accordingly, in the third embodiment, the same function as the protecting function shown in the above-mentioned second embodiment can be realized by a simplified circuit.

As the circuit structure of the detection means of the primary current of the ignition coil 3, in the first to third embodiments, there is shown the circuit which is made up of the IGBT 5 and the detection resistor 61 formed in series to the IGBT 5. However, the same effect as that in the present invention can be obtained in the case of a structure (a) using a bipolar power transistor or a structure (b) including an IGBT 5A for detection which is connected in parallel with the IGBT 5 and the detection resistor 61 which is inserted in series to an IGBT 65 as shown in FIG. 10. The IGBT 5 and the IGBT 5A connected in parallel with the IGBT 5 shown in FIG. 10B which are formed in one chip is called "IPD (intelligence power device)".

Then, the setting of a current value by which the switching element 5 is forcedly interrupted will be described.

Even in the case where the ignition signal is normal, when the current value comes up to the set current of the over-current interrupting function or higher due to the variation of the rising characteristic of the primary current, there is the possibility that ignition is conducted earlier than a normal ignition timing due to the over-current interrupting function.

Taking this drawback into consideration, it is necessary to set the current value of the over-current interrupting function. The rising characteristic of the ignition coil 3 changes in accordance with the variation of a primary resistance or inductance, a temperature variation or the like.

The temperature coefficient of copper which is a coil material is about 4300 ppm, the resistance of the coil is reduced at a low temperature, and the rising of the primary coil is quick. For example, the resistance at −30° C. is $$R(1+4300/1000000\times(-30-25))=0.76R.$$

Thus, the resistance becomes 0.76 times of that at 25° C. and the rising rate becomes about 1.3 times.

The primary resistance is about ±5%. The variation of the inductance can be almost ignored. Also, taking the variation due the power supply voltage fluctuation into consideration, a margin of about 15% needs to be taken.

As a result, the setting of a given current value for forcedly interrupting the primary current is $$1.3\times1.05\times1.15=1.57.$$

Thus, the given current value needs to be set to 1.6 times of the target current (maximum value of the primary current in the normal state) at the minimum.

Then, an example in which an IGBT is used as the switching element 5 will be described.

The switching element 5 is made up of, for example, a bipolar power transistor or an IGBT, and in general, the IGBT can allow a large current to flow therein in the same chip size as compared with the bipolar power transistor.

As described above, it is necessary that the setting of the current value of the over-current interrupting function take a sufficient margin with respect to the target characteristic. In the case of the same chip size, the application of the IGBT can ensure the sufficient margin as compared with the bipolar power transistor. Also, in the case where the same current value is set, the application of the IGBT can downsize the switching element.

Also, in the case where the above-mentioned IPD (intelligence power device) is used as the switching element 5, the same effect as that in the case of using the IGBT is obtained.

According to the present invention, because the power consumption of the switching element 5 in the abnormal state can be reduced in the present 14 V system, it is possible to downsize the switching element 5 and the radiator plate. Those effects are further large at the high voltage power supply 42 V (battery voltage 36 V).

FIG. 11 shows the waveform in the case where the protection circuit operates at 14 V and 42 V. For example, assuming that the coil resistance is $_1$ Ω, and a current by which the protecting function is effected is 10 A, the power consumption of VIt=(14−10)10t=40t is reduced in the case of 14 V whereas the power consumption of VIt=(42−10)10t=320t is reduced in the case of 42 V, thus being capable of reducing the power consumption of eight times in the case of 42 V.

The effects increase or decrease due to the set current or the coil resistance, but the present invention is effective in the 42 V system as described above.

The switching circuit having no power supply terminal generally requires an over-voltage interrupting function on the control circuit side. However, in the present invention, the over-voltage interrupting function on the control circuit side can be deleted.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ignition device for an internal combustion engine, comprising:

a waveform shaping circuit that waveform-shapes an ignition signal for controlling the supply/interruption of a primary current of an ignition coil;

a switching element that allows and interrupts the supply of the primary current on the basis of the ignition signal that is waveform-shaped to generate a high voltage on a secondary side of the ignition coil; and an over-current protection circuit that forcedly interrupts the supply of the primary current and holds an interrupt state until the ignition signal turns off when the primary current of the ignition coil has a given value larger than a maximum value of the primary current in a normal state.

2. An ignition device for an internal combustion engine according to claim 1, wherein the over-current protection circuit comprises:

a detection resistor which is connected in series to the switching element;

a comparator that compares a terminal voltage of the detection resistor with a given voltage of a reference power supply; and a latch circuit that controls the energization/disenergization of the switching element on the basis of the output of the comparator and the ignition signal.

3. An ignition device for an internal combustion engine according to claim 1, wherein the given value in the over-current protection circuit is 1.6 times or more of the maximum value at the time when the primary current is normal.

4. An ignition device for an internal combustion engine according to claim 1, wherein the switching element is an insulated gate bipolar power transistor.

5. An ignition device for an internal combustion engine, comprising:

a waveform shaping circuit that waveform-shapes an ignition signal for controlling the supply/interruption of a primary current of an ignition coil;

a switching element that allows and interrupts the supply of the primary current on the basis of the ignition signal that is waveform-shaped to generate a high voltage on a secondary side of the ignition coil;

an over-current protection circuit that forcedly interrupts the supply of the primary current and holds an interrupt state until the ignition signal turns off when the primary current of the ignition coil has a given value larger than a maximum value of the primary current in a normal state; and an energization time abnormality protection circuit that forcedly interrupts the supply of the primary current of the ignition coil and holds an interrupt state until the ignition signal turns off when the ignition signal exceeds a given energization time.

6. An ignition device for an internal combustion engine according to claim 5, wherein the energization time abnormality protection circuit comprises:

an integrating circuit that integrates a constant current on the basis of the ignition signal; and a comparator that compares an integrated voltage of the integrating circuit with a given voltage of a reference power supply and controls the energization/disenergization of the switching element on the basis of the comparison result.

7. An ignition device for an internal combustion engine according to claim 6, wherein the over-current protection circuit comprises:

a detection resistor which is connected in series to the switching element;

a comparator that compares a terminal voltage of the detection resistor with a given voltage of a reference power supply; and a latch circuit that controls the energization/disenergization of the switching element on the basis of the output of the comparator and the ignition signal.

8. An ignition device for an internal combustion engine according to claim 5, wherein the over-current protection circuit comprises:

a detection resistor which is connected in series to the switching element;

a comparator that compares a terminal voltage of the detection resistor with a given voltage of a reference power supply; and a latch circuit that controls the energization/disenergization of the switching element on the basis of the output of the comparator and the ignition signal.

9. An ignition device for an internal combustion engine, comprising:

a waveform shaping circuit that waveform-shapes an ignition signal for controlling the supply/interruption of a primary current of an ignition coil;

a switching element that allows and interrupts the supply of the primary current on the basis of the ignition signal that is waveform-shaped to generate a high voltage on a secondary side of the ignition coil;

an over-current protection circuit that outputs a given signal when the primary current of the ignition coil has a given value larger than a maximum value of the primary current in a normal state; and an energization time abnormality protection circuit that forcedly interrupts the supply of the primary current of the ignition coil and holds an interrupt state until the ignition signal turns off when the primary current of the ignition coil exceeds a given value or the ignition signal exceeds a given energization time on the basis of the given signal.

10. An ignition device for an internal combustion engine according to claim 9, wherein:

the over-current protection circuit includes a detection resistor which is connected in series to the switching element, and a comparator that compares a terminal voltage of the detection resistor with a given voltage of a reference power supply and outputs a comparison result; and the energization time abnormality protection circuit includes an integrating circuit that integrates a constant current on the basis of the ignition signal and the comparison result, and a comparator that compares the integrated voltage of the integrating circuit with a given voltage of the reference power supply and controls the energization/disenergization of the switching element on the basis of the comparison result.

11. An ignition device for an internal combustion engine, comprising:

an over-current protection circuit that forcedly interrupts a supply of a primary current of an ignition coil when the primary current of the ignition coil has a given value larger than a maximum value of the primary current in a normal state, wherein the interruption of the supply of the primary current is held until an ignition signal turns off.

12. The ignition device for an internal combustion engine according to claim 11, further comprising:

a waveform shaping circuit, that waveform-shapes the ignition signal, for controlling the supply and interruption of the primary current of the ignition coil; and a switching element that allows and interrupts the supply of the primary current, on the basis of the wave-shaped ignition signal, to generate a high voltage on a secondary side of the ignition coil.

13. The ignition device for an internal combustion engine according to claim 12, further comprising an energization time abnormality protection circuit that forcedly interrupts the supply of the primary current of the ignition coil when the ignition signal exceeds a given energization time, and holds an interrupt state until the ignition signal turns off.

* * * * *